US005676066A

United States Patent [19]

Cavalier et al.

[11] Patent Number: 5,676,066

[45] Date of Patent: Oct. 14, 1997

[54] APPARATUS WITH SLANTED RACK ON PALLET FOR TRANSPORTING GLASS

[75] Inventors: J. Carter Cavalier; John L. Park, both of Kenton, Ohio

[73] Assignee: Slantpac Corp., Kenton, Ohio

[21] Appl. No.: 735,530

[22] Filed: Oct. 23, 1996

Related U.S. Application Data

[63] Continuation-in-part of Ser. No. 586,023, Dec. 1, 1995, abandoned.

[51] Int. Cl.[6] ..... B65D 19/44

[52] U.S. Cl. ..... 108/55.1; 108/56.1

[58] Field of Search ..... 108/55.1, 55.3, 108/55.5, 51.1, 53.1, 53.3, 53.5

[56] References Cited

U.S. PATENT DOCUMENTS

| | | | |
|---|---|---|---|
| 3,193,093 | 7/1965 | Hansen | 108/55.1 X |
| 3,762,343 | 10/1973 | Thacker | 108/55.1 X |
| 4,890,560 | 1/1990 | Good | 108/55.1 X |
| 4,901,650 | 2/1990 | Armstead | 108/55.1 |
| 5,018,629 | 5/1991 | Lamar | 108/55.1 X |
| 5,348,149 | 9/1994 | McCarthy | 108/55.1 X |
| 5,388,532 | 2/1995 | Wakano | 108/55.1 |
| 5,404,821 | 4/1995 | Bond | 108/55.1 |
| 5,588,372 | 12/1996 | Kelly | 108/55.1 |

*Primary Examiner*—Jose V. Chen
*Attorney, Agent, or Firm*—Thomas E. O'Connor, Jr.

[57] ABSTRACT

Apparatus comprising a slanted rack on a pallet with enclosed forklift tine channels accessible from both sides and ends of the pallet; side frames providing stackability, with partial movability to allow unobstructed access during loading and unloading of glass; a slanted, cushioned rack to place and keep stored glass on a tilt to avoid glass falling forward affixed to the pallet; and dually adjustable straps with storable, cushioned front supports sensitively to affix side-stacked glass to the pallet and rack for safe transportation. Other embodiments may include detachable connections between the side frames and the slanted rack to the pallet that allows such frames and rack to be completely disassembled and placed flat on the surface of the pallet for return shipment. End plates for use with standard packaging material, walk-in capability for the pallet, complete collapsibility for return shipment, and stepping plates on the pallet for "pickers" are provided in alternate embodiments.

10 Claims, 5 Drawing Sheets

APPARATUS WITH SLANTED RACK ON PALLET FOR TRANSPORTING GLASS

CROSS-REFERENCES

The present application is a continuation-in-part application of (parent) application Ser. No. 08/586,023 filed Dec. 1, 1995 now abandoned, "Rack for Transporting Flat or Curved Glass," by J. Carter Cavalier.

GOVERNMENT RIGHTS

The present application pertains to an invention that was not performed under any federally sponsored research and development.

BACKGROUND

1. Field of Invention

The invention relates to a stackable and reusable rack for the safe transportation and storage and efficient loading and unloading of glass products, such as automotive windshields.

Use of the inventive rack allows efficient loading and unloading of glass, and safe storage and transportation of the loaded glass, with virtually no breakage and thus with an in-transit breakage percentage substantially below the industry standard in-transit breakage experience of three percent.

2. The Related Art

The prior art does not provide an effective means to transport, load and unload glass products safely and economically applying a re-usable packaging device. Flat and curved glass products, primarily automotive windows, usually were shipped in boxes comprised of a wooden frame covered by paperboard. Such box frames usually include vertical supports, and may or may not included horizontal supports. Such box frames typically were set on a bulky wooden pallet and moved by forklift truck. A disadvantage of this prior art is that such packaging material is bulky, awkward and not economical. Re-use of such packaging was limited because of the rapid fatigue and deterioration of the paperboard cover and wooden frame. Typically, such box frames are used a single time and then discarded; if re-used, rarely is such packaging re-used more than four times. Moreover, moisture, such as from precipitation, further diminishes the strength and integrity of the packaging. Therefore, the use of lumber and paper products for such packaging is an ineffective and non-economic use of natural resources.

Box frames set on a pallet are bulky and cannot be reduced in size after use. Accordingly, such box frames, even if intended to be used again, must be returned empty, thereby needlessly increasing shipping costs. The prior art further discloses packaging to secure the glass for transportation which is wasteful and inefficient. The vertical supports of typical box frames are perpendicular to the horizontal member or the pallet, which requires that the glass products be stacked perpendicularly. The sheets of glass rest on their respective edges, typically on corrugated paperboard which is used as padding. It has been a common practice also to use corrugated paperboard as padding between each piece of flat or curved glass. Non-adjustable straps are typically used to secure the glass products when loaded. Since the straps are non-adjustable, additional packing material such as paperboard must be added to remove the slack in the straps to secure the glass. Even with this arrangement, the glass products can shake side to side as the padding compresses or the straps loosen. The paperboard used as padding may compress or deteriorate from the weight of the glass or from moisture.

It is known in the prior art that automotive glass should be tilted during loading, unloading and transportation of the glass. If stacked vertically, perpendicular to the ground, such glass can easily can tip and fall over, giving the same effect as a row of dominos knocking each other over. Therefore, glass products tend to fall out during loading or unloading. This obviously leads to the problem of breakage.

The deficiencies in the typical prior art shipping arrangements are evident in that the vehicle glass industry allows for 3 percent breakage as a standard during the shipping of glass products.

Prior art devices to hold glass in an inclined positions have not succeeded in achieving the objects of the present invention. For example, McDowell U.S. Pat. No. 5,105,946 discloses a container for shipping sheets of glass. A front portion 16 including two end walls 17 are 18, a top panel 20 and end extension panels 22 and 23 is illustrated in FIG. 2 of that patent. The container disclosed in McDowell requires the use of a paperboard and frame box which provides most of the support for the glass products. Said box is secured to a large wooden pallet (12). The paperboard, frame and pallet can deteriorate from moisture and use. McDowell further discloses the disadvantage of shipping the glass vertically. McDowell teaches that the glass can be set in an inclined position during the unloading of the glass. Two wedge members, 42 and 43, comprised of separate, corrugate material, hold the glass vertically during transport. The wedges 42 and 43 must be removed and the glass products repositioned in order to tilt the glass backward toward a cradle 52 during unloading to avoid the problem of glass falling forward with potential breakage of the glass. Prior art devices such as McDowell, when put in use, typically required the user to insert a block of wood under the front of the pallet to prevent glass from falling forward and breaking during loading and unloading. The container disclosed in McDowell requires the use of a paperboard and frame box which cannot be reduced in size. If the McDowell container is intended to be reused, the container must be returned empty but in its original size.

An apparatus such as that disclosed by U.S. Pat. No. 5,388,532 issued to Wagano has also not been successful in solving the problems addressed by the present invention for the reasons that pin-construction at all connections has been found to fail to retain the rigidity needed in a successful rack. Further, the position of the head-rest taught by Wagano on the vertical stanchions causes the glass to fall forward and break during loading and unloading, again, as in other prior art devices, requiring a block of wood to be inserted under the front of the pallet to avoid this problem. Wagano's use of permanent, steel side plates in contact with the glass causes intolerable chipping. The absence of the proper cushioning, as used in the present invention, also leads to undesirable movement of the glass. The absence of dually adjustable straps and readily removable and storable side frames, combined with other deficiencies, make the device disclosed in Wagano an unsuccessful product.

In view of the above, it is apparent that there has existed a need in the art for a stackable, reusable rack which can be loaded and unloaded efficiently and which can store and transport glass safely and economically. There is a need in the art for a stackable apparatus that allows glass to be loaded, unloaded, stored and transported in a permanently inclined position. There is a need in the art for a rack which can optimally secure and cushion glass with the use of minimal packing material. There is a need in the art for a rack which can be collapsed into a space-saving size when returned for re-use. It is a purpose of this invention to fulfill this and other needs unfulfilled in the prior art.

SUMMARY OF THE INVENTION

The present invention fulfills the above described needs in the art by providing a stackable apparatus comprising a slanted, collapsible and reusable rack for transporting flat or curved glass and which can reduce damage to the glass during shipment, loading or unloading. Specifically, the present invention is a stackable apparatus for transporting automotive glass, comprising a pallet and a tilted cushioned setting block and cradle on the pallet, with removable, easily stored sides to allow the user efficiently to move the side frames out of the way for easy loading and unloading of glass. Cushioning material whose density is optimized for the weight of the glass products is placed under, behind, and in front of the glass being transported to reduce damage during handling shipment. Dually adjustable straps, surrounding the glass being affixed to the rack, accommodate various sizes of glass products and reduce damage during shipping and minimize the amount of packing material required. A cushioned flexible front support for positioning is provided in front of the glass between the glass and each strap. The inventive apparatus is stackable and may be partially or wholly collapsible after each use to allow the racks to be returned and re-used efficiently. Enclosed forklift openings are provided as part of the pallet to allow forklift access to the inventive apparatus from either side or either end of the rectangular pallet, all while maintaining the reclining position of the glass products to prevent tipping and breakage.

It is an object of the invention to provide a slanted rack which eliminates the need to prop up one side of a shipping container during shipping or unloading to prevent from glass falling forward and breaking. Another object of the invention is to minimize packing material by having optimally positioned straps and permanent cushioning to enable the safe transportation of glass. Another object of the invention is to provide an apparatus of sufficient strength to avoid the need for an outer container that could be damaged due to weather or accident, to support the glass. Another object of the invention is to provide sufficient framing for stacking. Another object of the present invention is to provide the capability of being manufactured of recyclable material, such as recycled steel, which reduces the waste of discarding precious lumber resources, such as wood and paperboard after only one or four uses of traditional packaging material. It is another object of the invention for the rack to be re-used for a period of approximately ten years. Another object of the invention is that the rack may be collapsible after use so that space is minimized when returning the empty rack for re-use. For example, approximately 215 of the inventive racks, when collapsed as described herein, could be returned on a standard tractor-trailer compared to 45 traditional box frames disclosed in the prior art; therefore, shipping costs for re-use are reduced. Another object of the invention is to have sufficient rigidity, in contrast to racks assembled using pins-in-holes to connect various parts, as such connections wear quickly in time, leading to a looseness or sloppiness in the rack leading to shifting and breakage of the glass.

Another object of the present invention is to provide dually adjustable straps to secure properly, through sensitive adjustability, the glass to the apparatus. Another object of the present invention is to provide cushioning material with appropriate coefficients of friction and softness to achieve maximum cushioning and durability but minimal slippage.

It is another object of the invention to provide straps that are of permanent shape to avoid undesirable stretching of the straps and loss of a secure holding of the stored glass in place during storage and transit.

Another object of one embodiment of the invention is to provide side plates to allow use of commercially available packaging material such as Foam-in-Place so that metal side plates are never in contact with glass.

Another object of one embodiment of the invention is to provide a walk-in opening in the front of the rack to allow a person, loading or unloading glass, to step closer to the precise location where a particular sheet of glass is being loaded or unloaded.

Another object of an embodiment of the invention is to provide plates to serve as a step for a warehouse worker or device sometimes referred to as a "picker," i.e., a warehouse employee using a hydraulic device such as a forklift who retrieves or "picks" various pieces (sizes) of glass for loading from the stored, inventive rack for shipment to distribution centers from manufactures; the "picker" can more conveniently handle glass by use of stepping plates on the pallet, which are convenient for said picker when he or she positions on the device being used by the picker on substantially the same level as the apparatus of the present invention on which glass is stored.

Another object of the invention is to provide a rack with end frames and front supports, which may be easily moved or stored by a worker during loading and unloading to allow maximum access to the slanted rack, during unloading and loading of the sheets of glass, and provide convenient, safe storage location so that such frames and supports can be readily retrieved and placed in their appropriate storage/shipment position upon completion of loading or unloading.

Another object of the invention is to provide an apparatus which is easily and safely stackable; prior art racks, if stackable at all, required intricate manipulation by a forklift operator to place the rack-being-stacked onto a precise location on the lower rack to achieve stability.

DETAILED DESCRIPTION

A. Preferred Embodiment

The preferred embodiment achieves the objects of the present invention and comprises a combination of elements not disclosed in the prior art. The preferred embodiment comprises those necessary features that make it useful in the real industrial world and allows automotive glass to be stored and transported with virtually no breakage, a dramatic result in light of the industry's average breakage rate of 3% which represents the wasting of thousands of sheets of glass. The preferred embodiment comprises: a pallet with enclosed forklift channels accessible from both sides and ends of the pallet; movable and storable side flames providing stackability; a slanted, cushioned rack to place and keep stored glass on a tilt to avoid glass falling forward; and dually adjustable straps with storable, cushioned front supports, to sensitively affix stacked glass to the pallet and rack for safe transportation.

Pallet With Enclosed Forklift Channels With Multi-directional Accessibility

Figure 1:
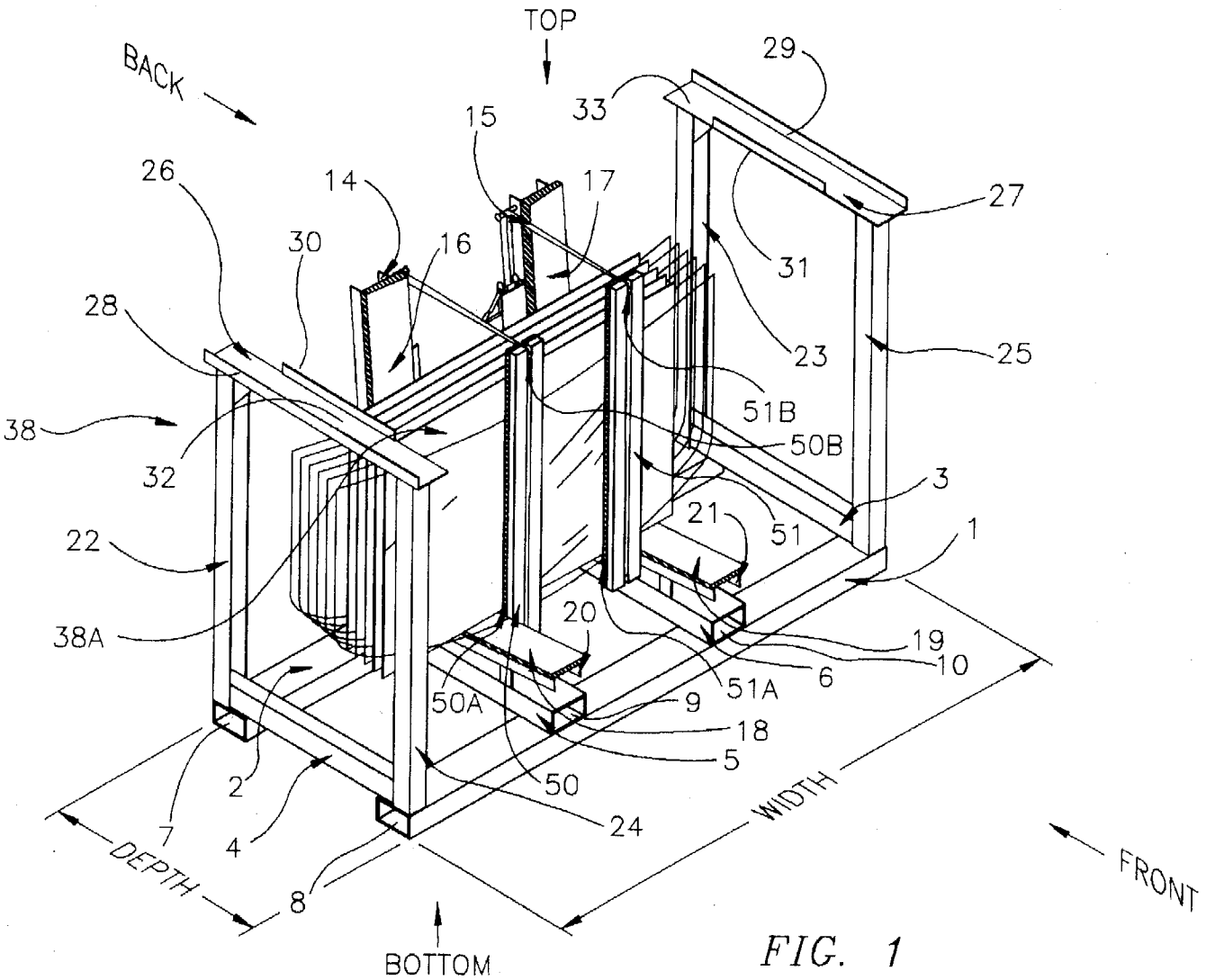
FIG. 1 provides an isometric view of the invention with a stack of windshields loaded and strapped into position for storage or transport.
Figure 3:
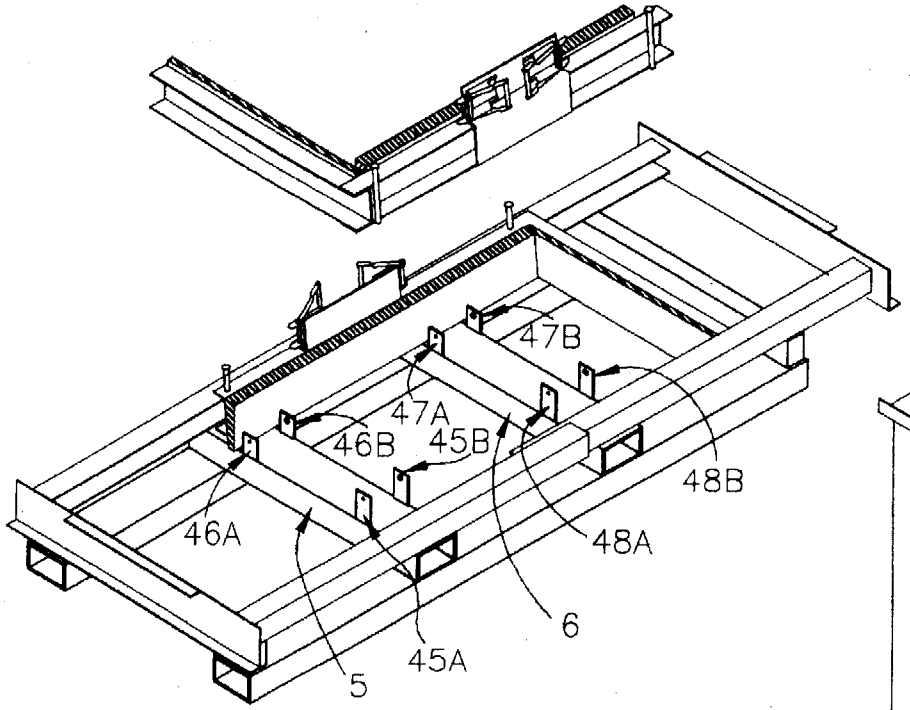
FIG. 3 shows one embodiment of the invention in which all parts are collapsed down onto a substantially horizontal plane for return shipment and showing flanges for accepting the bolts which secure the setting block.

A pallet comprising metal members (1, 2) positioned in parallel and defining the width and depth of the pallet as shown in FIG. 1. The rectangular pallet comprises depth metal structural members (3, 4) at the respective opposing ends of the width of the pallet and perpendicular to said width members 1 and 2. Also perpendicular to said members 1 and 2 are members (7, 8) positioned between said structural members 3 and 4, with the distances between said structural depth members being approximately equal. Said six structural members (1, 2, 3, 4, 5, 6) comprising the pallet are welded together to form a rigid pallet. Members 1 and 2 and 5 and 6 are made of metal with an enclosed rectangular cross section to provide enclosed channels (7, 8, 9, 10) for receipt of forklift tines accessible from either end or either the front or the back of the pallet. As shown in FIG. 3, members 5 and 6 are provided with upward protruding pairs of flanges: (45A and 45B, and 46A and 46B, and 47A and 47B, and 48A and 48B) said flanges being provided with a bore to receive a bolt.

Movable and Storable Frames Providing Stackability

The inventive device further comprises end frames, as shown in FIG. 1; one such comprises a pair of vertical support members (23, 25) positioned at the corners of the pallet at one end of its ends, a horizontal bridging member 29 attached to the top of the vertical support members 23 and 25; a second end frame comprises vertical members 22 and 24 with top horizontal bridging member 26. Said members 26 and 27 each have lip flanges (29 and 31; and 28 and 30, respectively) positioned upwardly to receive and to retain in place the respective ends of the lower surface of the structural members 1 and 2 of another identical pallet stacked on top of said lower pallet. Each of said end frames is movable and storable on the back of the inventive apparatus; e.g., the vertical support member of the side frame 25 and the horizontal bridging member 29 may be lifted by a user. In FIG. 2, position 29A shows the L-shaped portion of the end flame, comprising the front post and the horizontal member, after a user lifts said portion from its detachable shipping/stacking position. The corresponding detachable portion of the end frame from the opposing end is shown in FIG. 2 in the stored position (29B) for loading and unloading of glass.

Said end frames are shown in the stacking/transport mode in FIG. 1; the front post and the horizontal bridging member (25 and 29, and 24 and 26) are permanently attached in perpendicular relationship. The lower end of each front post (24, 25) is removably attached to the pallet, as shown in FIG. 2D; the upper end of each back post (22, 23) is also removably attached to the back end of the horizontal members (26, 27) as illustrated in FIG. 2E. Said removable attachments (shown in FIGS. 2D and 2E) allow a person to lift the end frame to come away from the back vertical post for storage on the back of the apparatus. Flanges (e.g., 33A and 33B) downwardly protruding from each horizontal member are positioned so as to engage storage points on the back of the apparatus (e.g., 33B-1 and 33C-1, respectively).

Slanted Cushioned Rack

In this art the two substantially horizontal members form what is commonly referred to as the setting block; the two substantially vertical members form what is commonly referred to as the cradle.

The slanted rack is shown in FIGS. 2, 4, 5 and 6. By reference to FIG. 2, the rack has two sections. One section comprises a substantially vertical cradle member (14) with an upper and a lower end, and a substantially horizontal setting block member (20), permanently affixed to each other at the lower end of said cradle member and at the rear end of said setting block member; the other section comprises cradle member (15) similarly affixed to setting block member (21). Each such member has an open or [-cross section as shown in the drawings. Bores (58, 59, 60 and 61) are provided in said setting block sections of the rack as shown in FIG. 2, positioned for alignment with the holes in the flanges (45A and 45B; 46A and 46B; 47A and 47B; 48A and 48B) upwardly protruding from pallet structural members 5 and 6, as shown in FIG. 3. The pair of substantially horizontal support members (20, 21) comprising the setting block are tilted at an optimum angle upwardly from the horizontal pallet, at an angle of approximately 3 to 5 degrees; thereby tilting the perpendicularly attached cradle backwardly at the same angle.

The horizontal support members (20, 21) comprising the setting block are provided with cushioning (18, 19) material, completing what typically in this art is referred to the setting block portion of the rack. The vertical supports 14, 15 are also provided with cushioning material (16, 17), forming what is commonly known as the cradle portion of the rack.

Figure 2B:
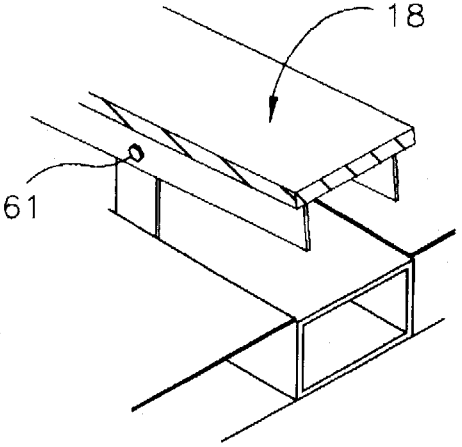
FIG. 2B shows the setting block or substantially horizontal section of the slanted rack, with cushioning and bolt to affix the front of the setting block to the pallet at an approximately five degree angle from the pallet.
Figure 2A:
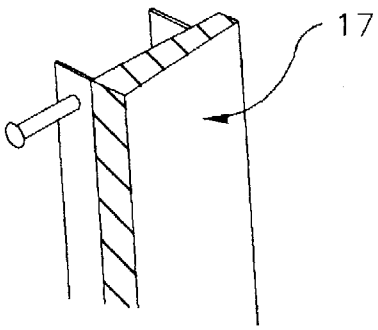
FIG. 2A shows the cushioning on the cradle or substantially vertical section of the slanted rack, with tapered cushioning to accommodate curved glass.
Figure 2:
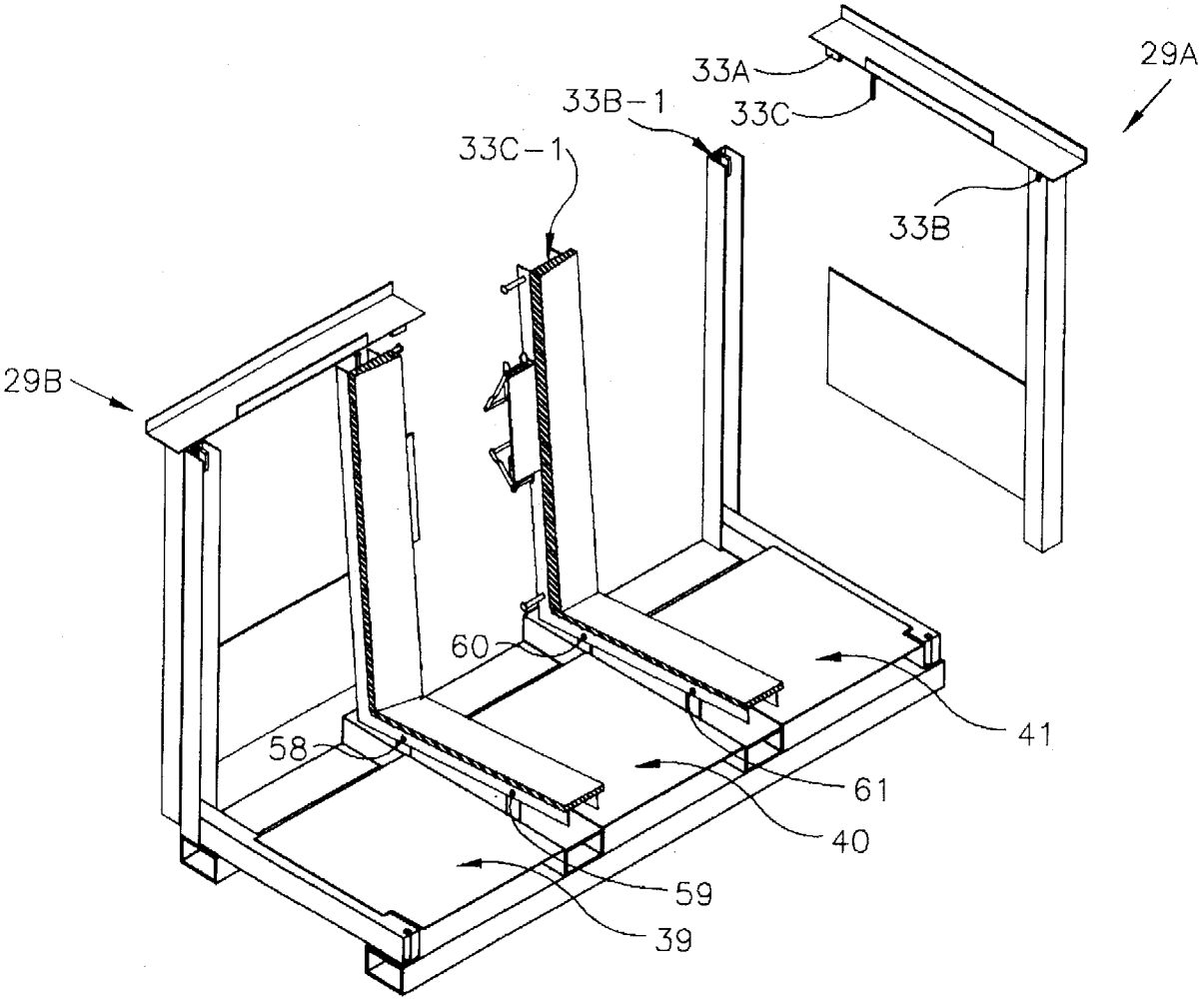
FIG. 2 shows the removable side frames. The frame on one end is shown in the mode (29A) after removal and before storage; the side frame of the opposing end is shown in the mode (28B) after being stored during loading and unloading of glass.
Figure 2E:
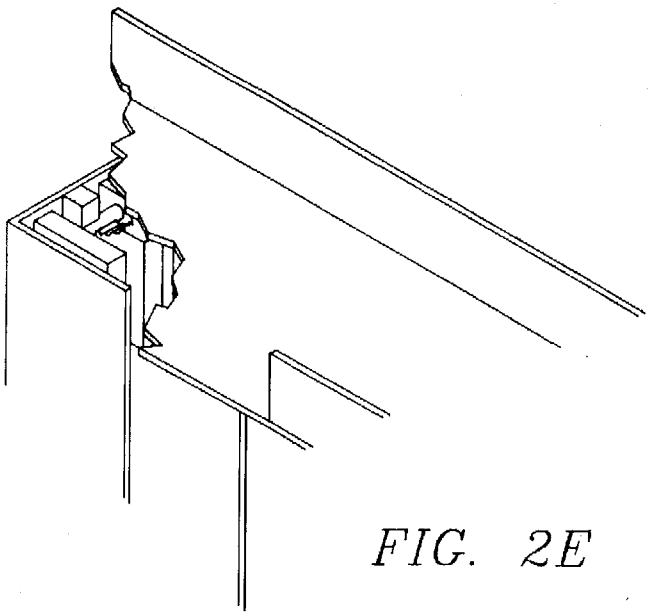
FIG. 2E illustrates the detachable connection between the top of the back corner post of the end fame and the back end of the horizontal stacking member.
Figure 2D:
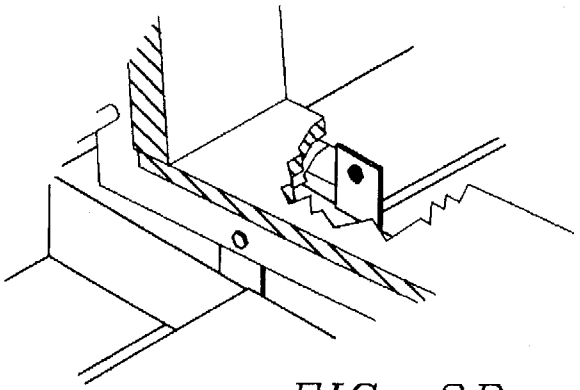
FIG. 2D shows the positioning of the bolt to affix the rear of the setting block to the pallet.
Figure 2C:
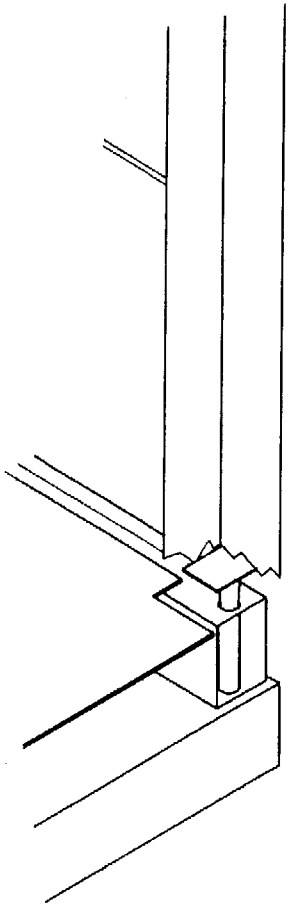
FIG. 2C illustrates the removable connection between the bottom of the front side vertical post to the pallet.

Said cushioning on said cradle portion is tapered as shown in FIG. 2A to conform to the typically concave interior surface of stored glass.

The density of the cushioning material setting block and cradle can be chosen to be appropriate to the weight of the stack of glass. The cradle cushions (16, 17) are four pound cross-link polyethylene foam. The setting block cushions must be selected to have an appropriate co-efficient of friction. A suitable material is 50 durometer natural gum strips. The preferred composition is intended to provide enough support to sustain, without compression of the composition and a consequent loosening of the wrapping straps, the weight of the glass products and to protect the glass products from marring, scratching or chipping.

The invention is used for removing and storing the movable portion of the end frames, by placing a stack (40) of glass products on the setting block 20, 21 and cradle 16, 17 as shown in FIG. 2, and by securing the stacked glass to the apparatus by use of the dually adjustable straps and cushioned, flexible front supports.

Dually Adjustable Straps With Storable Cushioned Front Supports

Figure 6:
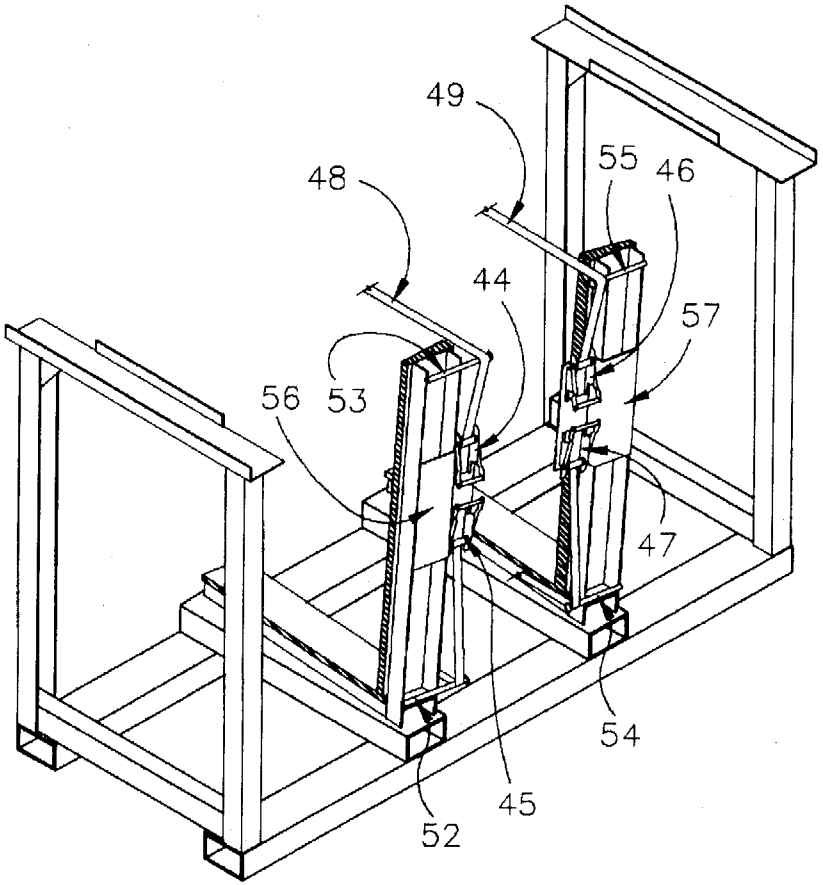
FIG. 6 shows the back view of the rack showing dual wenches on the back of each structural member comprising the cradle, for dual adjustability of each strap, and showing the pins (52 and 53, and 54 and 55) which serve as guides for the straps and as support for a downwardly extending pin in the horizontal section of the side flames when stored for loading and unloading, and plates (56 and 57) which partially enclose the back of each such member to form a channel in which the cushioned front support member may be stored during loading and unloading.

Straps and cushioned front supports are provided to affix the loaded glass in place for storage and transport. Wenches are provided on the back of the substantially vertical or cradle portion of the slanted rack as shown in FIG. 6. The straps 48 and 49 are positioned to surround the glass and front supports 50 and 51 said front supports are provided with cushioning material between said supports and the loaded glass. Cushioning material such as two pound cross link polyethylene foam is affixed to one surface of said front support, said material being positioned between the loaded glass and said front support. Said front support is made of appropriately flexible material, such as soft spruce wood to conform to the contour of the loaded glass when the straps are tightened. Said front supports have a notch at each end to receive a strap, as illustrated at 50B and 51B in FIG. 1, and are sized so as to be temporarily storable during loading and unloading of glass in the interior of said substantially vertical cradle members.

Straps must have adequate strength and be resistant to stretching; straps made from 207-blue 1" treated blue polyester webbing may be used. Each strap is dually adjustable from the top and the bottom to secure the loaded glass.

B. Other Embodiments

Stepping Plates

Figure 4A:
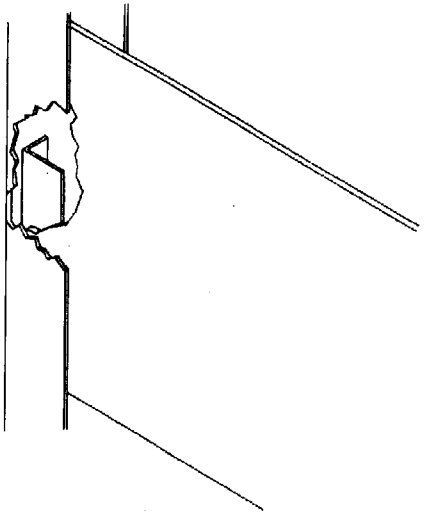
FIG. 4A shows the detachable connection of the back end of the end plates to the back vertical post of the end frame.
Figure 4:
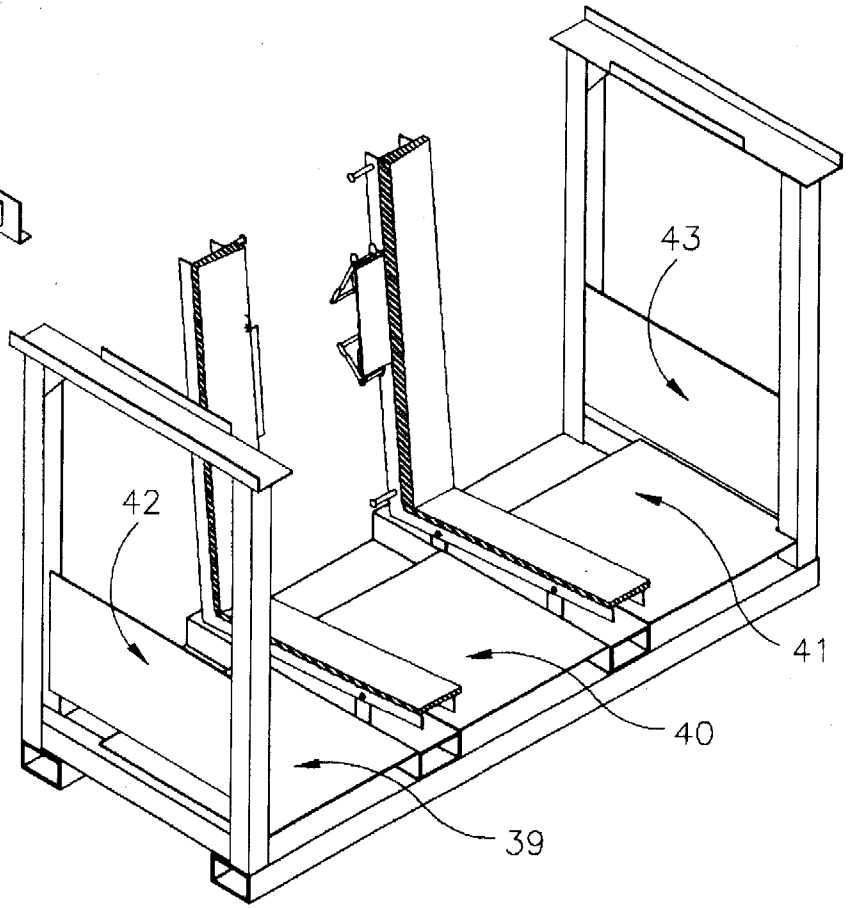
FIG. 4 illustrates the optional stepping plates (39, 40 and 41) and end plates (42 and 43).

Stepping plates (39, 40 and 41) as shown in FIG. 4 are provided to provide a step for a user who is elevated from ground level such as in a warehouse setting. This allows the warehouseman to adjust the height of his forklift-type device to that of the top surface of the step plates so that he may easily step to load and unload a piece of glass.

End Plates

In other embodiments metal end plates (42, 43 of FIG. 4) are provided in a fixed position to avoid contact between metal and glass and to allow use of standard foam packaging products, such as Foam-In-Place.

Complete Collapsibility

Detachable connections are provided between both lower ends of both side frames and the pallet, and also between the slanted rack and the pallet, allowing such frames and rack to be readily disassembled and placed flat on the surface of the pallet for return shipment, thereby using substantially reduced space and enabling economical return shipment which achieves environmentally and economically desirable reusability, as shown in FIG. 3.

The bolts through the flanges 45A and 45B, 46A and 46B, 47A and 47B, and 48A and 48B can be easily removed to allow the slanted rack to be positioned on the top surface of the pallet as shown in FIG. 3.

The rack 38 may be collapsible as shown in FIG. 3, to reduce the shipping cost when returning the slanted rack empty. One embodiment uses detachment of each vertical stacking member 22, 23, 24, 25 by having each slidably engaged into corresponding receptacles 34, 35, 36, 37, respectively, attached to the rack 45 and retained by a locking means such as a pin or bolt. The vertical stacking members 22, 23, 24, 25 when detached from the rack 45 could be inserted into the pallet cavities 5, 6 to simplify shipping the empty rack 38. The vertical support portion of the cradle is also collapsible for storage, during return shipment, on the pallet 45.

Walk-In Capability

Figure 5:
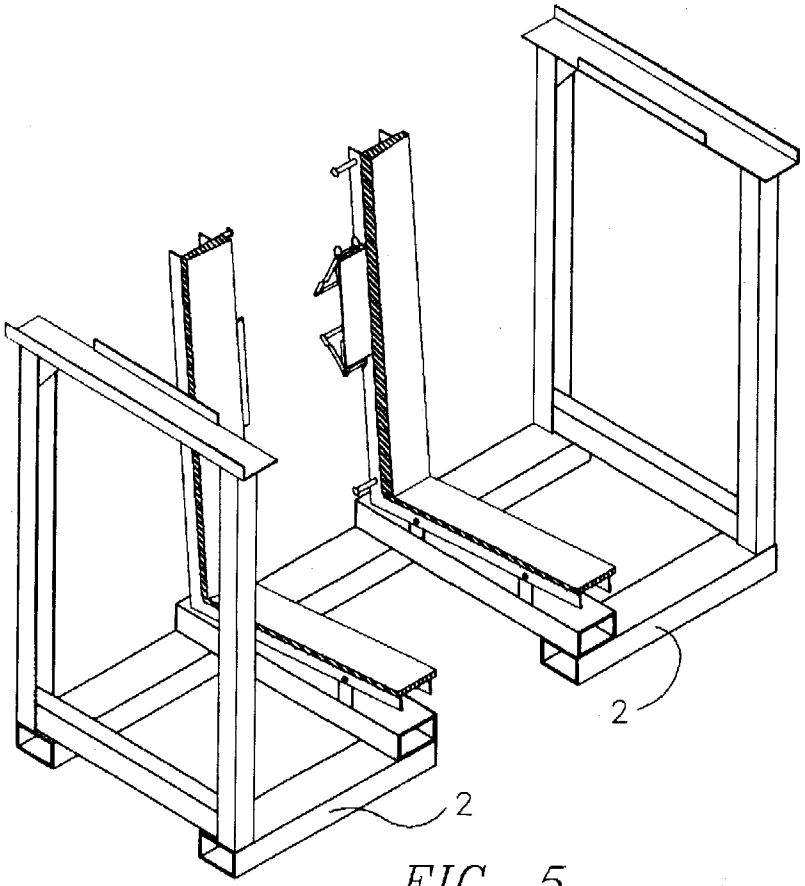
FIG. 5 illustrates another embodiment of the invention known as the walk-in embodiment in which there is an opening in the front of the pallet to allow a user to step towards the back of the rack to load or unload glass.

The pallet may be constructed, as shown in FIG. 5, to allow a user to walk into the apparatus while on ground level for purpose of more readily carrying glass to the precise point at which it is being loaded or unloaded. This is accomplished by having a central opening in the front width structural member (2) of the pallet.

While the invention has been described in connection with what is presentably considered to be the most practical and preferred embodiment, and other embodiments, it is to be understood that the invention is not to be limited to the disclosed embodiments, but on the contrary, is intended to cover various modifications and equivalent arrangements included within the spirit and scope of the foregoing specification and of the following claims.

Permanently Attached End Frames

The connections at the four corners of the end frames are permanent, i.e., the horizontal stacking member of the end frame is welded permanently to the upper ends of the vertical members of the end frames, and lower ends of said vertical members are welded to the pallet, as shown in FIG. 4.

We claim:

1. A stackable apparatus with slanted rack on a pallet, for storing and transporting sheets of glass, comprising:

a rectangular pallet having opposing ends, a front and a back, having fully enclosed forklift tine channels accessible from both sides and ends of said pallet;

end frames positioned at each of said opposing ends of said pallet, comprising:

pairs of front and back vertical posts at each corner of each of said ends positioned perpendicularly to said pallet;

a pair of horizontal stacking members each bridging the tops of one of said pairs of posts comprising said end frames and each of such stacking members being permanently affixed to the top of said front post and movably affixed to the top of said rear post and said bottom of said front post being movably affixed to the front corner of said pallet, an upper surface of said horizontal members having upwardly protruding flanges to receive and retain in a fixed position the bottom of a second, identical pallet when said second pallet is stacked on top of said horizontal member a slanted, cushioned rack comprising:

a substantially horizontal setting block member with a front end and a back end, and a substantially vertical cradle member with a top end and a bottom end, said setting block being permanently affixed in perpendicular relationship with said cradle, at the bottom of said cradle and the rear of said setting block, and being detachably affixed to said pallet at each end of said setting block, said front end of said setting block being positioned at approximately a 3 to 5 degree angle above horizontal thus causing the affixed cradle to be tilted backwardly at the same angle;

strapping system comprising:

straps each end of which is attached to adjustable wenches affixed to the rear of said cradle member to tighten each end of each strap;

cushioned, flexible front supports with a notch at each end to receive and guide said straps, each of said front supports being positionable between the strap and said sheets of glass loaded onto the slanted rack, so that each of said straps can be tightened at either end, said front supports being sized so as to be temporarily storable during loading and unloading of glass by being placeable in the hollow interior of said substantially vertical cradle members and being flexible to conform to the contour of the glass when said straps surround stored glass in a tightened mode;

end frame storage system comprising:

storage points comprising, on the back of said apparatus, openings in the tops of said back vertical posts and said substantially vertical cradle member;

downwardly protruding flanges from said horizontal stacking members, spaced so that said flanges are received by said storage points, so that the portion of said end frame comprising said horizontal stacking member and permanently affixed front post may be stored on the back of the apparatus during the loading and unloading of said sheets of glass.

2. The apparatus of claim 1 further comprising a detachably affixed rear corner post of each side frame so that said rack and said side feames may be disassembled and collapsed onto the upper surface of said pallet for return shipment.

3. The apparatus of claim 1 further comprising permanently positioned end plates, between the lower ends of the vertical posts comprising the side frames, to retain into position commercially available foam packing material if injected between the outside edges of the said sheets of glass and said end plates.

4. The apparatus of claim 1 further comprising horizontally positioned stepping plates, on the top of the upper surface of said pallet, so that a plate is provided on which a worker may step while loading or unloading glass on a rack stacked or positioned above ground level.

5. The apparatus of claim 1 wherein there is a permanent connection between the horizontal stacking member and the vertical posts of each side frame, and between the lower ends of said vertical posts and said pallet.

6. A stackable apparatus with slanted rack on a pallet, for storing and transporting sheets of glass, comprising:

a rectangular pallet having opposing ends, a front and a back, having fully enclosed forklift tine channels accessible from both sides and ends of said pallet said front of said pallet being comprised of two parts each extending inwardly from each of said opposing ends of the front of said pallet so as to allow a user to walk into the interior of the rack without having to step over any structural member above floor level;

end frames positioned at each of said opposing ends of said pallet, comprising:

pairs of front and back vertical posts at each corner of each of said ends positioned perpendicularly to said pallet;

a pair of horizontal stacking members each bridging the tops of each of one of said pairs of posts comprising said end frames and each of such stacking members being permanently affixed to the top of said front post and movably affixed to the top of said rear post and said bottom of said front post being movably affixed to the front corner of said pallet, an upper surface of said horizontal members having upwardly protruding flanges to receive and retain in a fixed position the bottom of a second, identical pallet when said second pallet is stacked on top of said horizontal member a slanted, cushioned rack comprising:

a substantially horizontal setting block member with a front end and a back end, and a substantially vertical cradle member with a top end and a bottom end, said setting block being permanently affixed in perpendicular relationship with said cradle, at the bottom of said cradle and the rear of said setting block, and being detachably affixed to said pallet at each end of said setting block, said front end of said setting block being positioned at approximately a 3 to 5 degree angle above horizontal thus causing the affixed cradle to be tilted backwardly at the same angle;

strapping system comprising:

straps each end of which is attached to adjustable wenches affixed to the rear of said cradle member to tighten each end of each strap; cushioned, flexible front supports with a notch at each end to receive and guide said straps:

each of said front supports being positioned between the strap and the glass loaded onto the slanted rack, so that each of said straps can be tightened at either end, said front supports being sized so as to be temporarily storable during loading and unloading of glass in the interior of said substantially vertical cradle members and being flexible to conform to the contour of the glass when said straps surround stored glass in a tightened mode;

end time storage system comprising:

storage points comprising, on the back of said apparatus openings in the tops of said back vertical posts and said substantially vertical cradle member;

downwardly protruding flanges from said horizontal stacking members spaced so that said flanges are received by said storage points so that the portion of said end frame comprising said horizontal stacking member and permanently affixed front post may be stored on the back of the apparatus during the loading and unloading of said sheets of glass.

7. The apparatus with walk-in pallet of claim 6, further comprising a detachably affixed rear corner post of each side frame so that said rack and said side frames may be disassembled and collapsed onto the upper surface of said pallet for return shipment.

8. The apparatus with walk-in pallet of claim 6, further comprising permanently positioned end plates, between the lower ends of the vertical posts comprising the side frames, to retain into position commercially available foam packing material between said plates and said material if injected between the outside edges of the said sheets of glass and said end plates.

9. The apparatus with walk-in pallet of claim 6, further comprising horizontally positioned stepping plates, on the top of the upper surface of said pallet, so that a plate is provided on which a worker may step while loading or unloading glass on a rack stacked or positioned above ground level.

10. The apparatus of claim 6, wherein there is a permanent connection between the horizontal stacking member and the vertical posts of each side frame, and between the lower ends of said vertical posts and said pallet.

* * * * *